United States Patent [19]

Ackerman

[11] Patent Number: 4,458,435

[45] Date of Patent: Jul. 10, 1984

[54] REMOVABLE MATERIAL SWATCH DISPLAY INCORPORATING TYPE MATCHED FIXED MATERIAL SWATCHES

[75] Inventor: Don Ackerman, Scotch Plains, N.J.

[73] Assignee: Economy Color Card Co., Inc., Roselle, N.J.

[21] Appl. No.: 482,591

[22] Filed: Apr. 6, 1983

[51] Int. Cl.[3] ..... G09F 19/00

[52] U.S. Cl. ..... 40/530; 40/405; 40/537; 434/75; 434/357

[58] Field of Search ..... 40/530, 405, 537; 434/367, 75

[56] References Cited

U.S. PATENT DOCUMENTS

| | | | |
|---|---|---|---|
| 2,121,246 | 6/1938 | Gordon | 434/357 |
| 2,707,839 | 5/1955 | Green | 434/75 |
| 3,530,593 | 9/1970 | Howard | 434/75 |
| 3,631,975 | 1/1972 | Leibowitz | 434/75 |
| 3,808,710 | 5/1974 | Ackerman | 434/75 |

FOREIGN PATENT DOCUMENTS

| | | | |
|---|---|---|---|
| 1184884 | 3/1970 | United Kingdom | 40/405 |

*Primary Examiner*—Gene Mancene
*Assistant Examiner*—Wenceslao J. Contreras
*Attorney, Agent, or Firm*—Lerner, David, Littenberg, Krumholz & Mentlik

[57] ABSTRACT

A material display which incorporates removable material swatches and type matched fixed material swatches. The removable swatches, once removed, may be returned to the display as desired, the fixed swatches showing the proper position for the removable swatches and covering the fixed swatches when in position.

9 Claims, 5 Drawing Figures

REMOVABLE MATERIAL SWATCH DISPLAY INCORPORATING TYPE MATCHED FIXED MATERIAL SWATCHES

BACKGROUND OF THE INVENTION

1. Field of the Invention

The present invention relates to material swatch displays, and more particularly to material swatch displays which incorporate fixed material swatches and removable material swatches which can be replaced after removal as desired.

2. Description of the Prior Art

It is frequently desirable to provide a material swatch display, for instance for fabric or the like, where the material swatches can be removed for use at a remote location. Such is often necessary for interior decorators or the like. However, when the swatch of material is removed, it is desirable to know by looking at the display exactly which swatch has been removed. In addition, when the swatch is returned to the display it is also desirable to know exactly in which position it belongs. Such a need is presently satisfied by swatch books which incorporate a small fixed sample of material that is fixedly secured to a display sheet on the back side thereof, the swatch of material being visible through a cutout. In addition, removable material display swatches are known which comprise a piece of material and a similarly sized piece of cardboard affixed thereto at one end thereof. The pieces of cardboard or the like are provided for insertion through slots in the display sheets such that insertion of the cardboard through the slot causes the removable swatch of material to be mounted on the display. The small fixed samples of material are positioned such that the cardboard of the removable sample of material does not preclude or hinder insertion of the cardboard in the slot.

While such a configuration satisfies basic needs, such swatch displays are not aesthetically pleasing since the cutouts for the fixed samples of material must be located at a position other than the area of the display sheet which is covered by the removable swatches since location of the fixed swatches of material adjacent to the slots would cause interference when the cardboard or the like of the removable swatches is inserted through the slots and jams against the adjacent fixed sample. As a result, presently known displays usually locate the fixed sample of material directly below the removable sample swatch. While this is effective in providing a fixed sample and a removable swatch, it is distracting when studying the usually larger removable swatches since the eye of the user is constantly diverted to the less appealing small samples of material.

The present invention overcomes the problems associated with the prior art by providing a material display which incorporates fixed material swatches that are entirely covered when the removable swatches thereof are placed into position such that an aesthetically more pleasing display is provided.

SUMMARY OF THE INVENTION

Therefore, a primary object of the present invention is to provide a material display which includes both fixed material swatches and matching removable material swatches.

A still further object of the present invention is to provide a material display wherein removable material swatches can be removed and then replaced as desired for virtually an unlimited number of removals and replacements.

A still further object of the present invention is to provide a material display wherein the fixed material swatches thereof are totally covered by the removable material swatches when placed in position.

Still another further object of the present invention is to provide a material swatch display which can be incorporated into a ring-type notebook.

Another further object of the present invention is to provide a material display which is ideally suited for use with fabrics.

Another still further object of the present invention is to provide a material display which is simple in design, relatively inexpensive to manufacture, rugged in construction, easy to use, and efficient in operation.

These objects as well as further objects and advantages of the present invention will become readily apparent after reading the ensuing description of a nonlimiting, illustrative embodiment and reviewing the accompanying drawings.

A material display according to the principles of the present invention comprises a display sheet having a plurality of slots disposed therethrough and a plurality of openings adjacently disposed therethrough, each of the slots being associated with a different one of the openings; a plurality of removable sample swatches, each of the removable sample swatches including a backing sheet dimensioned for insertion in the slots and a similarly sized piece of selected material, the selected material in each instance being affixed at one edge thereof to the associated backing sheet, insertion of the backing sheets in the associated slots causing the pieces of fabric to reside adjacent to the front side of the display sheet and a portion of the backing sheets to reside adjacent to the rear side of the backing sheet, the associated openings thereby being covered by the associated pieces of selected materials; a plurality of fixed sample swatches of selected materials each fixedly secured to the display sheet on the rear side thereof over an associated opening; and deflector sheet means fixedly secured to the back side of the display sheet, the deflector sheet means and the display sheet sandwiching therebetween the plurality of fixed sample swatches for precluding the backing sheets from being engaged by the associated fixed sample swatches when the backing sheets are inserted through the associated slots.

BRIEF DESCRIPTION OF THE DRAWING

In order that the present invention may be more fully understood, it will now be described, by way of example, with reference to the accompanying drawing, in which.

DESCRIPTION OF THE PREFERRED EMBODIMENT

Figure 1:
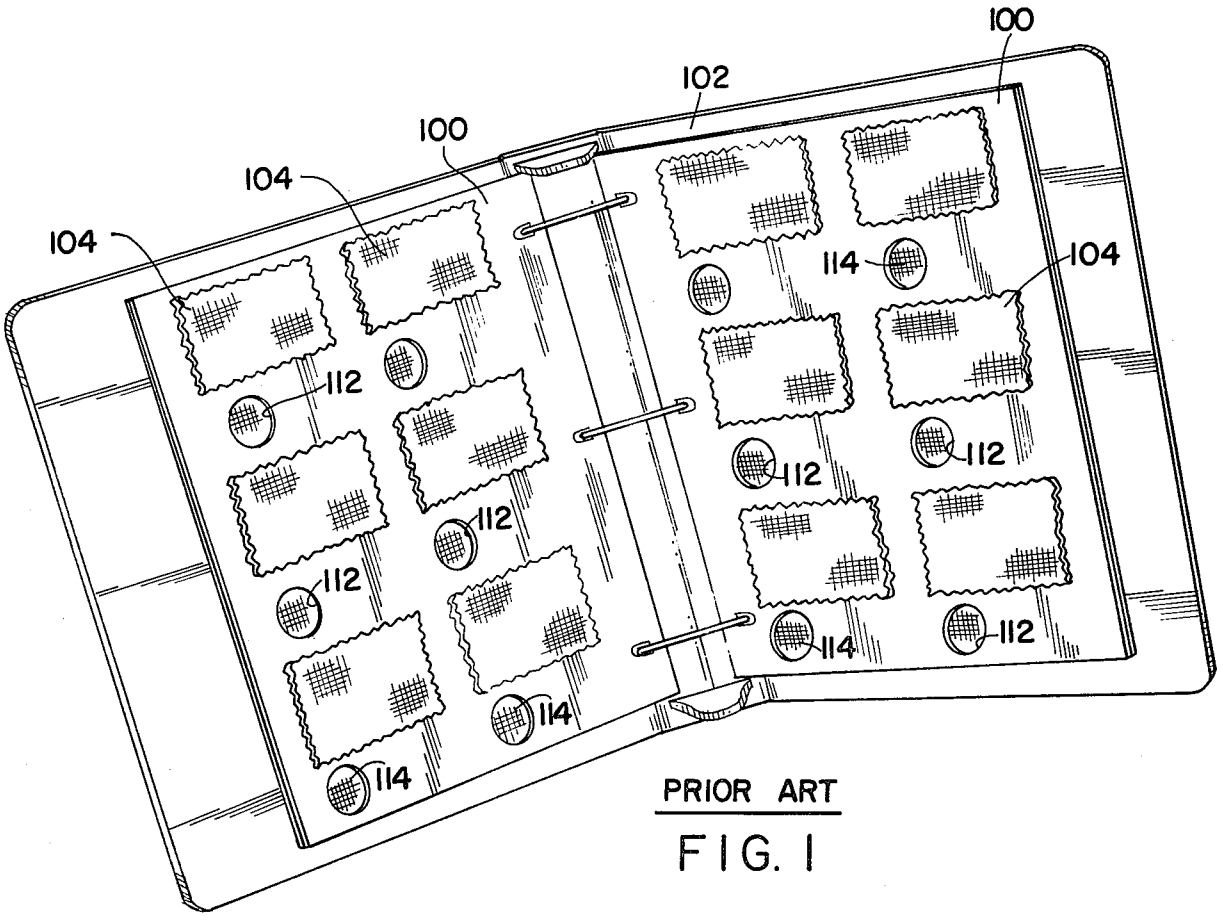
PRIOR ART FIG. 1
FIG. 1 is a pictorial representation of a PRIOR ART material display.
Figure 2:
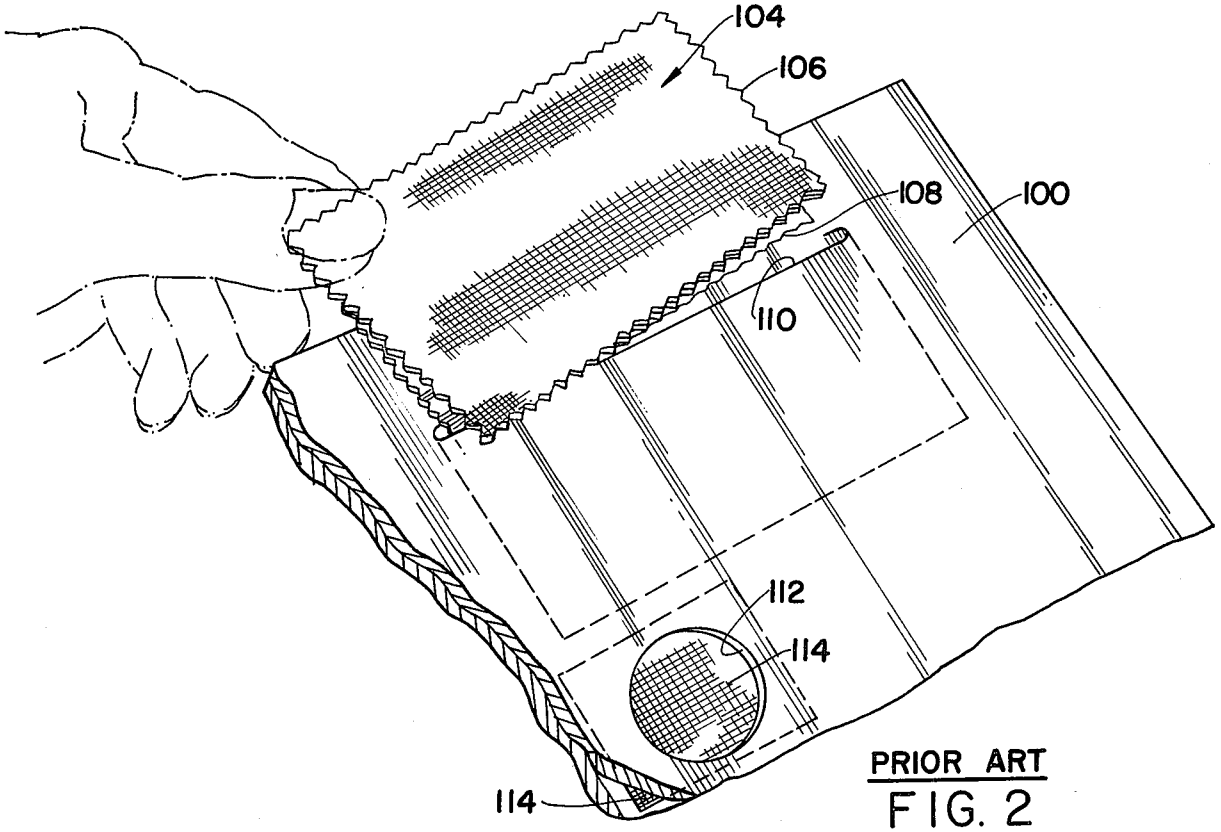
PRIOR ART FIG. 2
FIG. 2 is an enlarged partially broken away view of the PRIOR ART display of FIG. 1.

Referring now to the figures, and more particularly to FIGS. 1 and 2 thereof, there is illustrated therein a prior art material display which incorporates display cards 100 mounted in a three-ring binder 102. The display cards 100 mount a plurality of removable swatches 104 of material which are removable. The swatches 104 each comprise a piece of material 106 and a backing card 108 for insertion in a slot 110 disposed in the display card 100. Also disposed in the display cards 100 are a plurality of apertures 112 behind which are mounted a plurality of fixed swatches 114 which form what are generally known as "color dots". The fixed swatches 114 are disposed below the area the pieces of material 106 cover on the display cards and therefore are exposed and visible when the swatches 104 are in position. The fixed swatches 114 are so placed, since the backing cards 108, sized the same size as the removable swatches 104, must not interfere with the edges of the fixed swatches 114 when inserted in position on the display cards. As shown in FIG. 2, in phantom, the fixed swatches 114 and apertures 112 are located such that the backing cards 108 do not come in contact therewith since, if the edge of the backing card 108 was pushed against the fixed swatch 114 the fixed swatch 114 could be torn loose or the backing card 108 could be torn or otherwise destroyed.

While the prior art construction shown in FIGS. 1 and 2 does removably display the swatches 104 and also provides fixed swatches 114 which permit the user to know which removable swatches have been removed and also the proper position to locate the removable swatches when they are to be returned, an aesthetically unpleasing configuration is created wherein the user's eyes are constantly drawn from the removable swatches to the disturbingly placed fixed swatches. Such aesthetics are particularly important in the field of interior decorating and presenting material swatches of fabric, for instance, in the most pleasing and undistracting manner, is important. However, there heretofore has not been known a method for combining removable swatches with fixed swatches wherein the fixed swatches are in a "color dot" configuration and are hidden by the removable swatches when in position.

Figure 3:
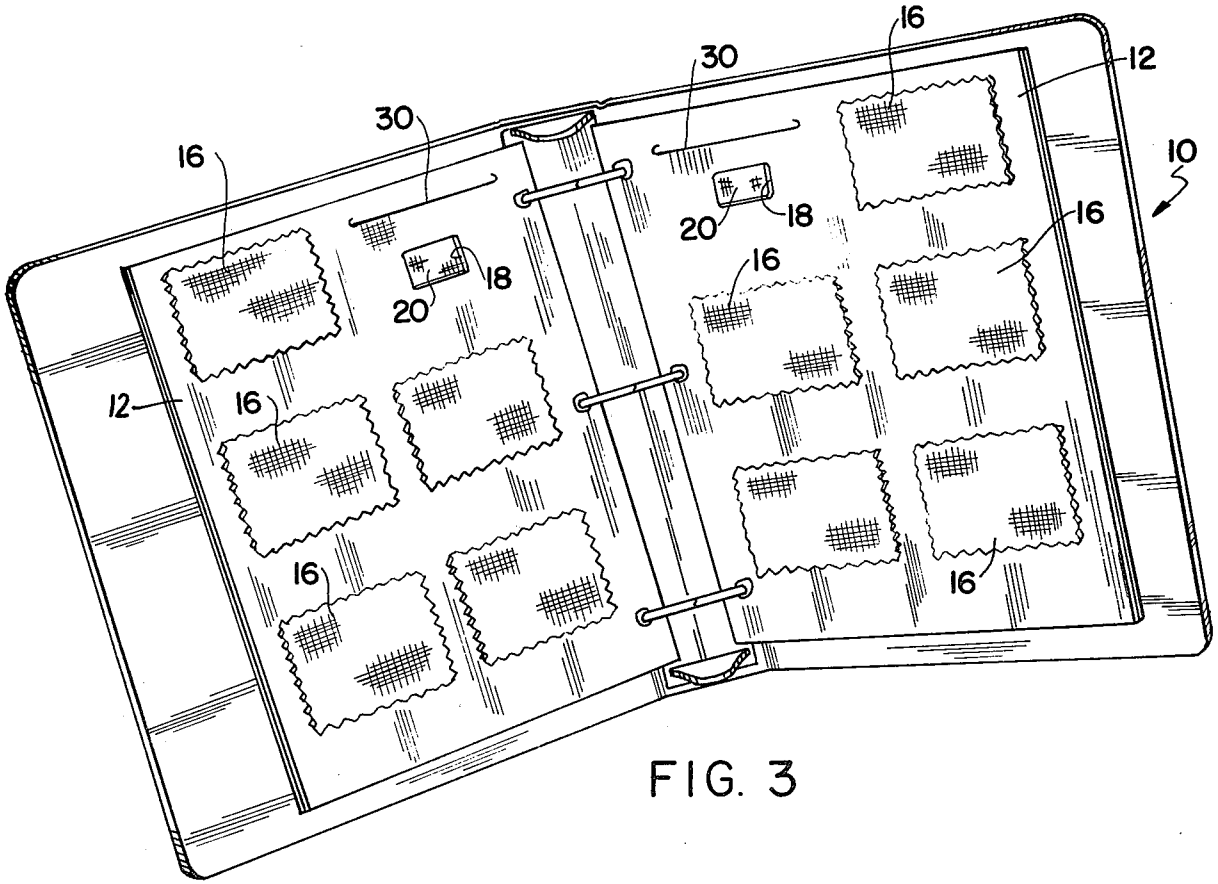
FIG. 3 is a pictorial representation of the preferred embodiment of the present invention.
Figure 4:
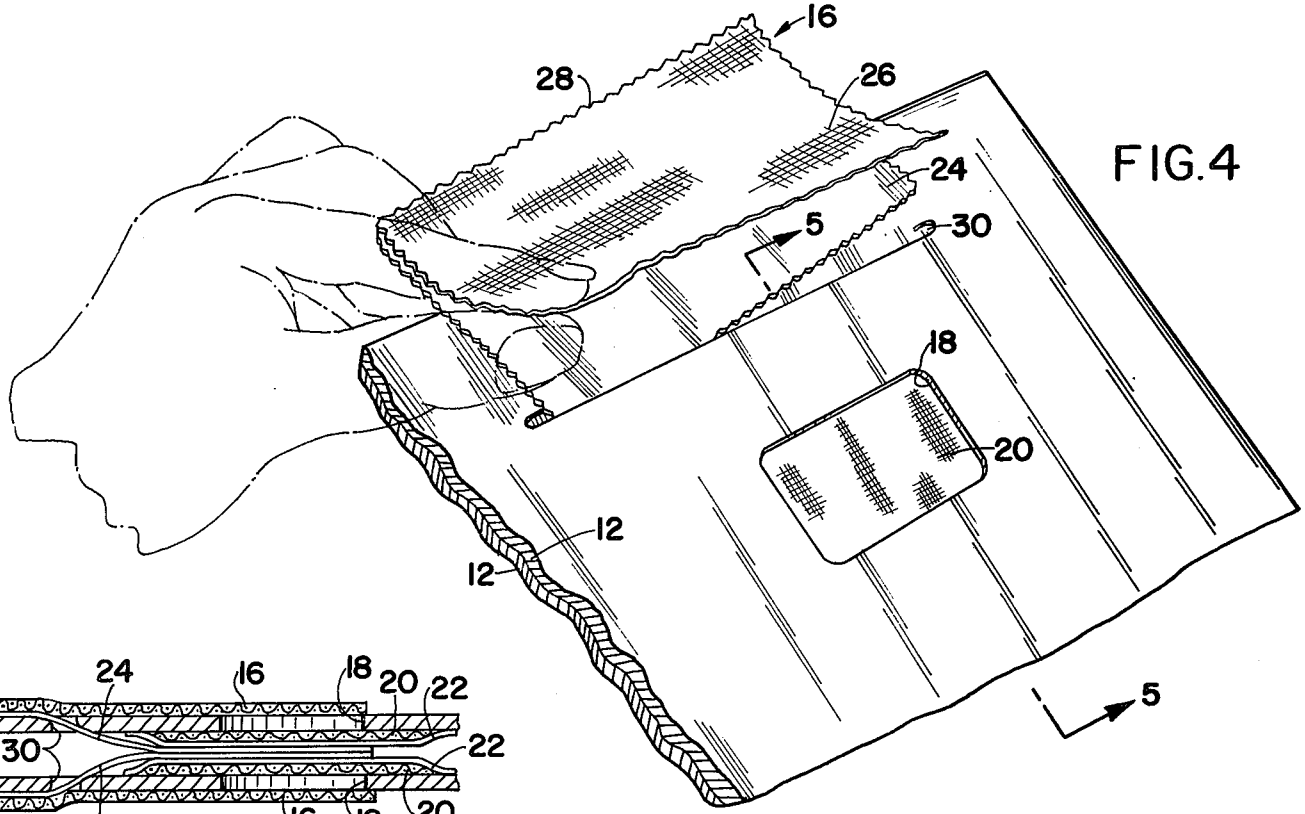
FIG. 4 is an enlarged partially broken away view perspective of the preferred embodiment of FIG. 3.
Figure 5:
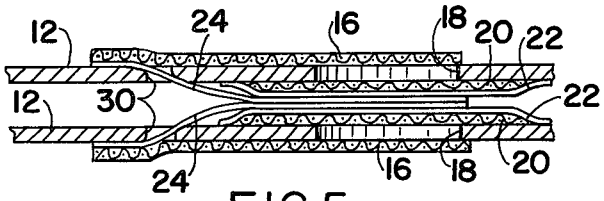
FIG. 5 is a fragmentary cross sectional view taken along the lines 5—5 of FIG. 4, but illustrating the removable swatch in an inserted position.

Turning now to the present invention, there is illustrated in FIG. 3 a material display 10 which incorporates the principles of the present invention. The material display 10 includes a display sheet 12 punched for mounting in a conventional three-ring binder 14. In direct contrast to the display of the prior art device shown in FIG. 1, a plurality of removable sample swatches 16 are displayed without distraction of identifying "color dots" or fixed swatches. With reference to FIGS. 4 and 5, it is apparent that "color dots" are provided but that they reside directly behind the position that the removable sample swatches 16 occupy when in position.

Specifically, each of the display sheets 12 shown have a plurality of apertures 18 disposed therethrough. Mounted behind the apertures 18 are a plurality of fixed sample swatches 20 fixedly secured to each of the display sheets 12 by suitable means such as an adhesive or the like. The fixed sample swatches 20 are therefore visible through the apertures 18.

Covering each of the fixed sample swatches 20 is a thin sheet of paper 22, as shown in FIG. 5, which is larger than the individual fixed sample swatches 20 and which serves to taper the edge surfaces of the swatches 20 into the back side of the display sheet 12. A single sheet of paper 22 can be employed or a plurality of separate sheets can be employed, one sheet covering each fixed sample swatch 20. In addition, materials other than paper can be employed for sheet 22, as desired by the user.

The removable sample swatches 16 each comprise a backing card 24 and a piece of material 26. The backing card 24 and the piece of material 26 are similarly sized and are joined together at an edge 28. The backing card 24 is dimensioned for insertion in the slots 30 disposed through the display sheet 12, a slot 30 being provided for each of the removable sample swatches 16.

When a backing card 24 is inserted through an associated slot 30, the edge of the backing card 24 is deflected away from the edge of the fixed sample swatch 20 by the sheet 22 so that it can pass easily and smoothly thereover without hanging up or causing damage either to the backing card 24 or the fixed sample swatch 20. As a result, removable sample swatches 16 having similarly sized backing cards can be positioned on the display sheet 12 to entirely cover the fixed sample swatches 20. It is not necessary for the sheets 22 to cover the entire associated fixed sample swatches 20 to effect the desired deflection and only the possibly interfering edge of the fixed sample swatches 20 need be covered. Such a configuration is deemed to be within the scope of the present invention.

The backing cards 24 can be used to carry suitable indicia as desired and are the same size as the pieces of material 26 as an expedient for manufacture and for providing durability to the sample. Of course, the piece of material 26 of the removable sample swatches 16 are of the same type of material as the corresponding fixed sample swatches 20, in the preferred embodiment both being of fabric.

Although not essential to the invention, the preferred embodiment employs two display sheets 12 being mounted back-to-back and being sealed on their edges to form a pocket therebetween. As a result, the pair of display sheets 12 forms a display, both sides of which can carry a plurality of removable sample swatches 16 and fixed sample swatches 20. As illustrated in FIG. 5, the sheets 22 deflect the backing cards not only for the adjacent fixed sample swatch but also for the correspondingly positioned fixed sample swatch on the adjacent display sheet 12.

It is to be understood that other configurations and arrangements of removable sample swatches 16 and fixed sample swatches 20 can be provided within the principles and scope of the invention, the essential principle being that the backing cards 24 of the removable sample swatches 16 are deflected over the fixed sample swatches 20 by sheets 22 of paper or the like, such that the removable sample swatches 16 can cover the fixed sample swatches 20. Further, it will be understood that various changes in the details, materials, arrangements of parts and operational conditions which have been herein described and illustrated in order to explain the nature of the invention may be made by those skilled in the art within the principles and scope of the invention.

Having thus set forth the nature of the invention, what is claimed is:

1. A material display comprising:

a display sheet having a plurality of slots disposed therethrough and a plurality of openings adjacently disposed therethrough, each of said slots being associated with a different one of said openings;

a plurality of removable sample swatches, each of said removable sample swatches including a backing sheet dimensioned for insertion in said slots and a similarly sized piece of selected material, said selected material in each instance being affixed at one edge thereof to the associated said backing sheet, said slots and said openings being disposed and said backing sheet being sized so that upon insertion of said backing sheets in an associated said slot said pieces of fabric reside adjacent to the front side of said display sheet and a portion of said backing sheets reside adjacent to the rear side of said display sheet, the associated said openings thereby being covered by the associated said pieces of said selected material;

a plurality of fixed sample swatches of selected materials each fixedly secured to said display sheet on said rear side thereof over an associated said opening; and deflector means disposed and arranged with respect to said plurality of fixed sample swatches for precluding said backing sheets from being caught on the associated said fixed sample swatches when said backing sheets are inserted through the associated said slots.

2. A material display in accordance with claim 1, wherein said deflector means comprises at least one sheet fixedly secured to said back side of said display sheet, said deflector means and said display sheet sandwiching therebetween said plurality of fixed sample swatches.

3. A material display in accordance with claim 1, further comprising an additional sheet overlaying the back side of said display sheet.

4. A material display in accordance with claim 3, wherein said additional sheet is fixedly secured on the edges thereof to said display sheet.

5. A material display in accordance with claim 3, wherein said additional sheet is configured as said display sheet for accommodating selected ones of said plurality of removable sample swatches and said plurality of fixed sample swatches as said display sheet, a second deflector means being provided and being fixedly secured to the back side of said additional sheet, said second deflector means and said additional sheet sandwiching therebetween said selected ones of said plurality of fixed sample swatches.

6. A material display in accordance with claim 1, wherein said piece of material of each of said plurality of removable sample swatches is of the same type of material as the associated fixed sample swatches.

7. A material display in accordance with claim 1, wherein each of said pieces of material and said fixed sample swatches comprise fabric.

8. A material display in accordance with claim 2, wherein said deflector means comprises a plurality of separate sheets.

9. A material display in accordance with claim 8, wherein said separate sheets are affixed on the edges thereof to said display sheet.

* * * * *